United States Patent [19]

Bauer

[11] 4,128,347

[45] Dec. 5, 1978

[54] CHARACTERS-CARRYING DISC FOR PRINTING MACHINE, METHOD OF MANUFACTURING THIS DISC AND MOULD FOR CARRYING OUT THIS METHOD

[76] Inventor: Alfred Bauer, Rue Maujobia 95, 2000 Neuchâtel Canton of Neuchâtel, Switzerland

[21] Appl. No.: 796,517

[22] Filed: May 13, 1977

[30] Foreign Application Priority Data

May 24, 1976 [CH] Switzerland ..... 6514/76

[51] Int. Cl.[2] ..... B41J 1/32

[52] U.S. Cl. ..... 400/144.2; 249/160

[58] Field of Search ..... 197/53, 54; 249/110, 249/160; 400/144.2–144.4

[56] References Cited

U.S. PATENT DOCUMENTS

| | | | |
|---|---|---|---|
| 3,278,152 | 10/1966 | Miller et al. | 249/160 X |
| 3,442,365 | 5/1969 | Ragland et al. | 197/53 |
| 3,921,784 | 11/1975 | Orlens | 197/54 |

FOREIGN PATENT DOCUMENTS

| | | | |
|---|---|---|---|
| 2132345 | 1/1972 | Fed. Rep. of Germany | 197/53 |

*Primary Examiner*—Paul T. Sewell

*Attorney, Agent, or Firm*—Silverman, Cass & Singer, Ltd.

[57] ABSTRACT

A unitary character-bearing disc for use with printing machines, the disc having a hub and at least a pair of radial flexible arms, the whole of these arms having their terminal ends lying in a common plane while each second arm has its root integrally formed with the hub in the vicinity of one of the faces thereof, the root of each alternate arm being disposed in the vicinity of the opposite face of the hub, the roots of the radial arms being thereby seen to be disposed in two different planes. Each arm is thicker at the root than at the terminal end thereof. The invention further describes a two-element mould for making the disc as a unitary body. One of the elements of the mould is provided with a first set of radial grooves and a second set of radial grooves, both sets having common center points, the second set of grooves being deeper than the first set, each groove of the second set prolongating inwardly of each second groove of the first set. The second element of the mould has radial ribs alternating with radial grooves. The two mould elements are matable, their center points being coincident.

4 Claims, 8 Drawing Figures

FIG. 1
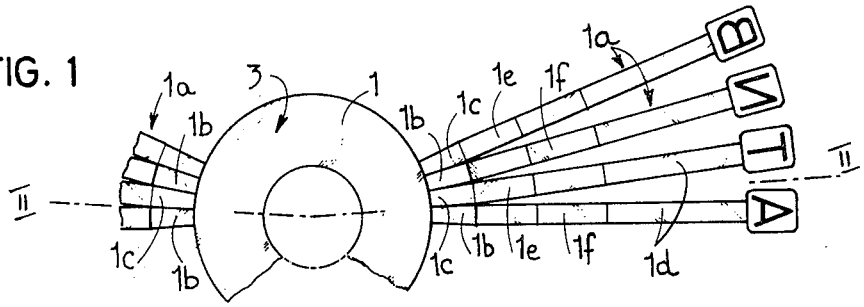
FIG. 2
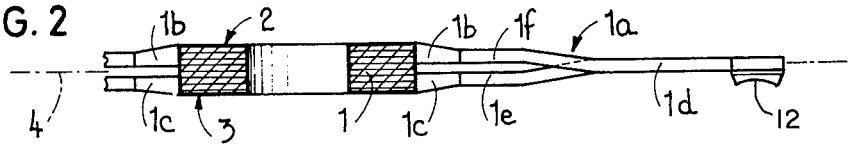
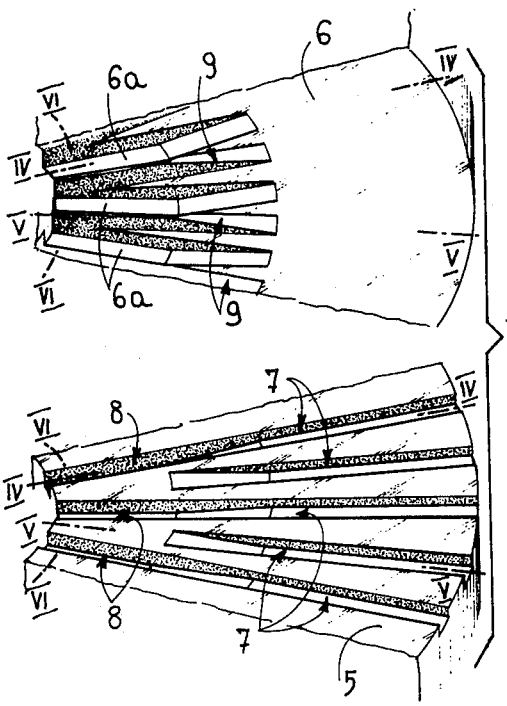
FIG. 3
FIG. 4
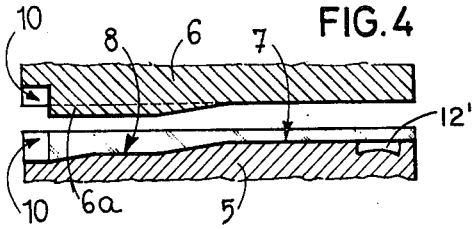
FIG. 5
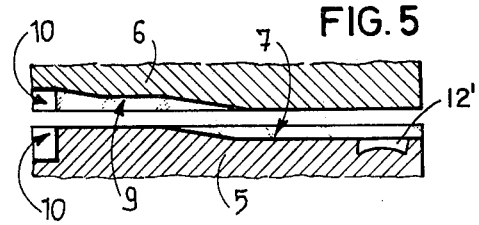
FIG. 6
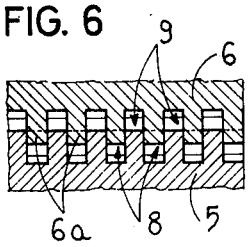
FIG. 7
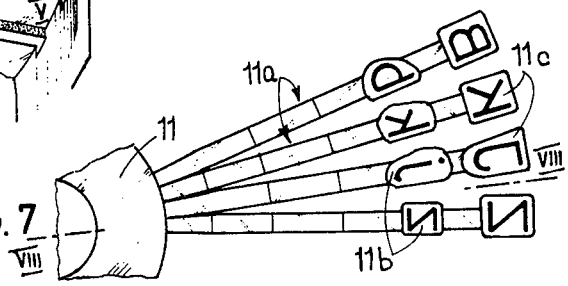
FIG. 8
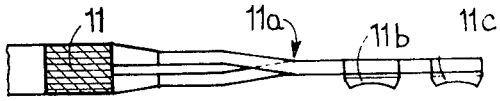

CHARACTERS-CARRYING DISC FOR PRINTING MACHINE, METHOD OF MANUFACTURING THIS DISC AND MOULD FOR CARRYING OUT THIS METHOD

The present invention relates to a characters-carrying disc for printing machine, comprising a central part, constituting a hub, from which extend flexible and resilient radial arms.

The invention relates also to a method of manufacturing this disc and to a mould for carrying out this method.

Characters-carrying discs for printing machine of the above mentioned type are known. Due to the relatively high number of the radial arms with which they are provided, it is necessary, so that these arms keep some width at their root, that the central part constituting a hub be relatively great, that increases the general dimensions of the disc.

It has been suggested to realise smaller discs, with small hubs, in two parts or elements, each element constituting a disc per se provided with the half of the total number of the radial arms of the disc finished, the ends of these arms being situated out of the plane of the central part of each element of the disc. These two elements are applied against each other, the ends of their radial arms being situated in a common plane corresponding to the contact plane of the two elements of the disc, the arms of one of the elements being disposed opposite the free spaces between the arms of the other element.

This arrangement has the drawback that each disc must be realised in two elements, that renders the manufacturing more complicated, especially due to the fact that it necessitates their assembling, the angular relative position the two elements must occupy having, moreover, to be extremely precise, that necessitates the realisation, in these elements, of positioning means which are difficult to be obtained.

The object of the present invention is to furnish a disc of relatively small dimension, of same configuration as the discs realised in two elements, but which is made in one piece, and to furnish means permitting to reach this purpose.

The characters-carrying disc according to the invention is characterised by the fact that its central part is thicker than the said flexible arms, the whole of these arms having their ending part situated in a same plane while each second arm has its root attached to a central part of the disc in the vicinity of one of the faces of the disc and the root of each other second arm, alternatively, situated in the vicinity of the opposite face of the disc, so that the roots of the said arms be situated in two different planes and that, hence, no friction be produced between them during the elastic deformation of them which occurs during the stamping.

The method of manufacturing this disc, according to the invention, is characterised by the fact that one realises this disc in one piece, by moulding.

The mould according to the invention, for carrying out this method, which is constituted of two elements applied one against each other is characterised by the fact that one of the said elements is provided with a first set of grooves, disposed radially with respect to a central point, and with a second set of grooves, also disposed radially with respect to the said point, deeper than the first ones, and which are prolongating inwardly each second groove of the first set, the second element of the mould being provided, situated in the vicinity of its center, with radial ribs alternating with radial grooves, the length of which and the position of which with respect to their central point corresponding substantially to the length and to the position of the grooves of the second set of the first element, the arrangement being such that, when the two elements of the mould are applied one against the other, their central points being in coincidence, the radial ribs of the second element be engaged in the grooves of the second set of grooves of the first element, while the grooves of the second element are situated in the prolongation of these of the grooves of the first set of the first element which are not prolongated by the grooves of the second set, the whole in such a way that the ending part of the flexible and resilient arms of the disc be realised by means of the first set of grooves of the first element of the mould, while the roots of the said arms are obtained, for the ones, by the second set of grooves of the first element of the mould and, for the others, by the grooves of the second element of the mould.

The drawing shows, by way of example, one embodiment of the characters-carrying disc according to the invention and a modification, as well as one embodiment of the mould according to the invention.

FIG. 1 is a plan view of a part of a first embodiment of a characters-carrying disc for a printing machine.

FIG. 2 is a sectional view along line II-II of FIG. 1.

FIG. 3 is a perspective view of a part of the two elements of a mould for obtaining the characterscarrying disc of FIGS. 1 and 2.

FIG. 4 is a sectional view along the two lines IV—IV of FIG. 3, the two elements of the mould being represented slightly separated one from another.

FIG. 5 is a sectional view similar to this of FIG. 4, along the two lines V—V of FIG. 3.

FIG. 6 is a transversal circular sectional view along the two lines VI—VI of FIG. 3.

FIG. 7 is a plan view of a part of a modification of a characters-carrying disc for a printing machine, and FIG. 8 is a sectional view along line VIII—VIII of FIG. 7.

The characters-carrying disc represented in FIG. 1, made of plastic material, comprises a central part 1, constituting a hub, presenting, on its whole periphery, radial arms which are flexible and resilient, only a part of which have been represented, generally designated by 1*a*, and which are provided, at their end, with a reverse relief 1 of the characters to be printed.

Each second arm 1*a* has its root, designated by 1*b*, situated in the vicinity of one of the faces, designated by 2, of the hub 1, which is relatively thick, while each other arm 1*a* has its root, designated by 1*c*, situated in the vicinity of the opposite face, designated by 3, of the hub 1. However, all the arms 1*a* are ended by a part 1*d* the whole of which are situated in the same plane, indicated by the line 4 of FIG. 2, which constitutes the median plane of the characters-carrying disc.

The result of this arrangement is that, in spite of the fact that the arms 1*a* are very close from each other at their root, due to the fact that a hub 1 is of small diameter, these arms can be deformed resiliently on their whole length, up to the hub itself, without rubbing one against each other at their root.

The characters-carrying disc as disclosed and represented is obtained by moulding by means of a mould, partially represented in FIGS. 3 to 5, comprising a lower element 5 and an upper element 6.

The lower element 5 is provided with a first set of grooves 7 arranged radially with respect to a central point, which is not represented in the drawing, corresponding to the center of the disc to be realised, and a second set of grooves, designated by 8, which are deeper than the grooves 7, which prolongate inwardly each second groove 7.

The element 6 of the mould is provided, situated in the vicinity of its center, with radial ribs 6*a* alternating with radial grooves 9, the length of which and the position of which with respect to their central point, not represented in the drawing, but which corresponds to the center of the characters-carrying disc to be realised, correspond to the length and to the position of the grooves 8 of the element 5 of the mould.

When the two elements 5 and 6 of the mould are applied one against each other, their central points being in coincidence, the radial ribs 6*a* of the element 6 are engaged in the grooves 8 of the element 5 while the grooves 9 of the element 6 are situated in the prolongation of these ones of the grooves 7 of the element 5 which are not prolongated by the grooves 8.

It results from this arrangement that the whole ending parts 1*d* of the arms 1*a* of the characters-carrying disc are realised by means of the whole grooves 7, while the roots 1*c* of the arms as well as the parts 1*e* thereof, which connect the roots to the ending parts 1*d*, are obtained by means of the grooves 8 of the element 5, the roots 1*b* of the arms and the parts 1*f* connecting these roots to the parts 1*d* being obtained by means of the grooves 9 of the element 6 of the mould.

It is to be noted that the element 5 of the mould is provided, situated at the ends of the grooves 7, with the relief 12 of the characters which are to be stamped by the characters-carrying disc, this relief having not been represented in the drawing in detail so as to overload this latter but is represented generally in phantom by reference character 12' in FIGS. 4 and 5.

FIG. 6 shows how the two elements of the mould, in the vicinity of a central hole 10, provided in each of these elements, serving to the realisation of the hub 1, are imbricated one in each other.

The modification of the characters-carrying disc partially represented in FIGS. 7 and 8 distinguishes from the first embodiment mainly by the fact that each arm, designated by 11*a*, of the disc, designated by 11, carries two reverse reliefs of the characters, 11*b* and 11*c*, and not only one as in the first embodiment.

Beside the advantages as mentioned hereabove, the invention has the advantage of permitting that the characters-carrying arms be thin and wide at their end while being narrow and thick at their root, the arms keeping a section of same surface, but of different shape, on their whole length.

What I claim is:

1. A unitary character-bearing disc for use with a printing machine, the disc comprising:

a central hub portion having opposite faces;

at least first and second sets of radially extending flexible and resilient radial arms formed integrally with the central hub portion about the outer periphery thereof, each arm having a root at the inner end thereof integrally formed with said hub portion, each arm further having a terminal end at the end thereof opposite said root, said hub portion being thicker than the combined thickness of one each of said flexible arms from each of the sets taken at the roots of said arms, the roots of one set of arms lying in a different plane than the roots of the other set of arms so that the roots of alternate arms extending from the central hub portion lie in different planes, the terminal ends of all arms of all sets lying in the same plane, the plane of one set of roots being located near one face of said hub portion and the plane of the other set of roots being located near the opposite face of said hub portion, the root of each arm being thicker in a direction substantially parallel to the longitudinal axis of the hub portion than is the terminal end of said arm, the root of each arm further being more narrow in a plane substantially perpendicular to the longitudinal axis of the hub portion than is the terminal end of said arm, the alternatingly out-of-plane roots being thereby integrally formed with the central hub portion yet being positioned thereon to enable the arms to be freely moveable along their length independently of the others and capable of being flexed without friction therebetween; and, means for defining characters at the terminal ends of said arms.

2. A mould for forming a unitary character-bearing disc for use with a printing machine, said disc being of the type having a hub and a plurality of integral radially outwardly extending flexible resilient arms arranged in a pair of sets with each of the arms having a root and a terminal end, the roots being thicker in planes substantially parallel to the longitudinal axis of the hub than the terminal ends, the roots further being more narrow in a plane substantially perpendicular to the longitudinal axis of the hub than the terminal ends, one of said sets having the roots of the individual arms thereof lying in one plane and the other of said sets having the roots of the individual arms thereof lying in a second different plane, the radial arms of one set alternating with the radial arms of the other set, the terminal ends of all arms lying in a common plane, said mould comprising a pair of matable mould elements having a common center point, a first set of radial grooves formed in one of said mould elements disposed about said central point and a second set of radial grooves formed in said one mould element also disposed about said central point, said second set of grooves having a greater depth and a more narrow width than the first set of grooves and said second set of grooves being an inwardly directed extension of alternate ones of said first set of grooves, a third set of radial grooves and a set of radial ribs formed in said other of said mould elements, said third set of grooves having a greater depth and a more narrow width than the first set of grooves, each of the ribs alternating with each one of said third set of radial grooves, the length and location of said ribs and third radial grooves relative to the center point of said other mould element corresponding substantially to the length and location of the respective ones of said second set of grooves formed in said one mould element, said pair of mould elements being matable with their center points coincident and with the set of radial ribs engaged in the respective ones of the grooves of the second set of grooves and the third set of grooves disposed coincident with the portions of the first element adjacent those grooves of the first set of grooves which are not extended by the respective grooves of the second set of grooves, whereby the terminal ends of the flexible and resilient arms of the disc are formed in the first set of grooves while the roots of one of said sets of arms are formed in the second set of grooves and the other of said sets of arms are formed in the third set of grooves.

3. A mould as claimed in claim 2 and means defining reverse relief formations formed in said first mould element at the outer ends of each of said first and second sets of grooves whereby to enable formation of the characters carried by the terminal ends of said radial arms.

4. A mould as claimed in claim 2 wherein there is a central recess formed in each of said pair of mould elements coaxial with said central points whereby to form said hub.

* * * * *